US008092281B2

(12) United States Patent
Masumura et al.

(10) Patent No.: US 8,092,281 B2
(45) Date of Patent: Jan. 10, 2012

(54) POLISHING HEAD AND POLISHING APPARATUS

(75) Inventors: Hisashi Masumura, Nishishirakawa (JP); Koji Kitagawa, Nishishirakawa (JP); Kouji Morita, Nishishirakawa (JP); Hiromi Kishida, Nagano (JP); Satoru Arakawa, Nagano (JP)

(73) Assignees: Shin-Etsu Handotai Co., Ltd., Tokyo (JP); Fujikoshi Machinery Corp., Nagano-shi (JP)

( * ) Notice: Subject to any disclaimer, the term of this patent is extended or adjusted under 35 U.S.C. 154(b) by 406 days.

(21) Appl. No.: 12/311,690

(22) PCT Filed: Oct. 18, 2007

(86) PCT No.: PCT/JP2007/001137

§ 371 (c)(1),
(2), (4) Date: Apr. 9, 2009

(87) PCT Pub. No.: WO2008/050475

PCT Pub. Date: May 2, 2008

(65) Prior Publication Data

US 2009/0291623 A1 Nov. 26, 2009

(30) Foreign Application Priority Data

Oct. 27, 2006 (JP) ..... 2006-293206

(51) Int. Cl.
*B24B 5/35* (2006.01)

(52) U.S. Cl. ..... 451/285; 451/290

(58) Field of Classification Search ..... 451/285, 451/286, 288, 290

See application file for complete search history.

(56) References Cited

U.S. PATENT DOCUMENTS

| | | | | |
|---|---|---|---|---|
| 5,635,083 | A * | 6/1997 | Breivogel et al. | 451/289 |
| 6,036,587 | A | 3/2000 | Tolles et al. | |
| 6,179,694 | B1 * | 1/2001 | Quek | 451/286 |
| 6,435,955 | B2 * | 8/2002 | Denda et al. | 451/286 |
| 6,443,823 | B1 | 9/2002 | Tolles et al. | |
| 6,739,958 | B2 * | 5/2004 | Chao et al. | 451/288 |
| 6,848,980 | B2 * | 2/2005 | Chen et al. | 451/285 |
| 6,974,371 | B2 * | 12/2005 | Chen et al. | 451/285 |

(Continued)

FOREIGN PATENT DOCUMENTS

| | | |
|---|---|---|
| JP | A-05-069310 | 3/1993 |

(Continued)

*Primary Examiner* — Maurina Rachuba
(74) *Attorney, Agent, or Firm* — Oliff & Berridge, PLC

(57) ABSTRACT

The present invention is a polishing head provided with an annular rigid ring, a rubber film bonded to the rigid ring with a uniform tension, a mid plate joined to the rigid ring and forming a space portion together with the rubber film and the rigid ring, and an annular template provided concentrically with the rigid ring in a peripheral portion on a lower face part of the rubber film and having an outer diameter larger than an inner diameter of the rigid ring, in which a pressure of the space portion can be changed by a pressure adjustment mechanism, a back face of a work is held on the lower face part of the rubber film, and a surface of the work is brought into sliding contact with the polishing pad attached onto a turn table for performing polishing, and an inner diameter of the template is smaller than an inner diameter of the rigid ring, and a ratio between an inner diameter difference between the rigid ring and the template and a difference between the inner diameter and an outer diameter of the template is 26% or more and 45% or less. Thereby, a polishing head and the like that can obtain constant flatness stably can be provided.

16 Claims, 4 Drawing Sheets

U.S. PATENT DOCUMENTS

| | | | | |
|---|---|---|---|---|
| 7,094,139 | B2 * | 8/2006 | Marohl et al. | 451/288 |
| 7,255,637 | B2 * | 8/2007 | Bennett et al. | 451/385 |
| 7,497,767 | B2 * | 3/2009 | Chen et al. | 451/398 |
| 7,520,955 | B1 * | 4/2009 | Zuniga et al. | 451/286 |
| 7,534,364 | B2 * | 5/2009 | Zuniga et al. | 438/692 |
| 7,677,958 | B2 * | 3/2010 | Marohl et al. | 451/285 |
| 2001/0003883 | A1 * | 6/2001 | Denda et al. | 451/286 |

FOREIGN PATENT DOCUMENTS

| | | |
|---|---|---|
| JP | A-09-139366 | 5/1997 |
| JP | A-10-180626 | 7/1998 |
| JP | A-2001-232553 | 8/2001 |
| JP | A-2002-514517 | 5/2002 |
| JP | A-2004-327547 | 11/2004 |
| WO | WO 99/58297 A1 | 11/1999 |

* cited by examiner

[Figs. 1]
(a)
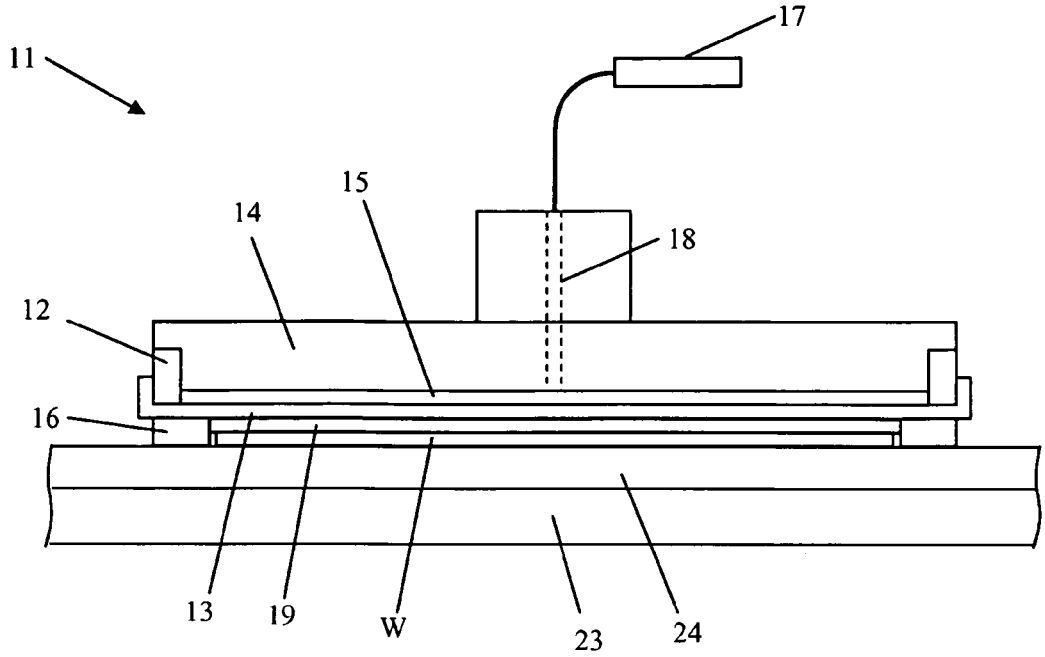
(b)
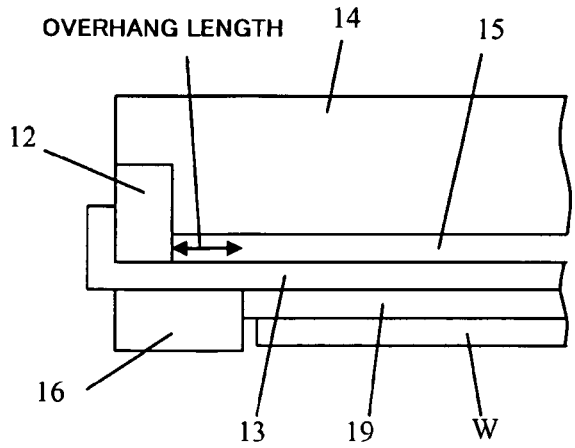

[Fig.2]
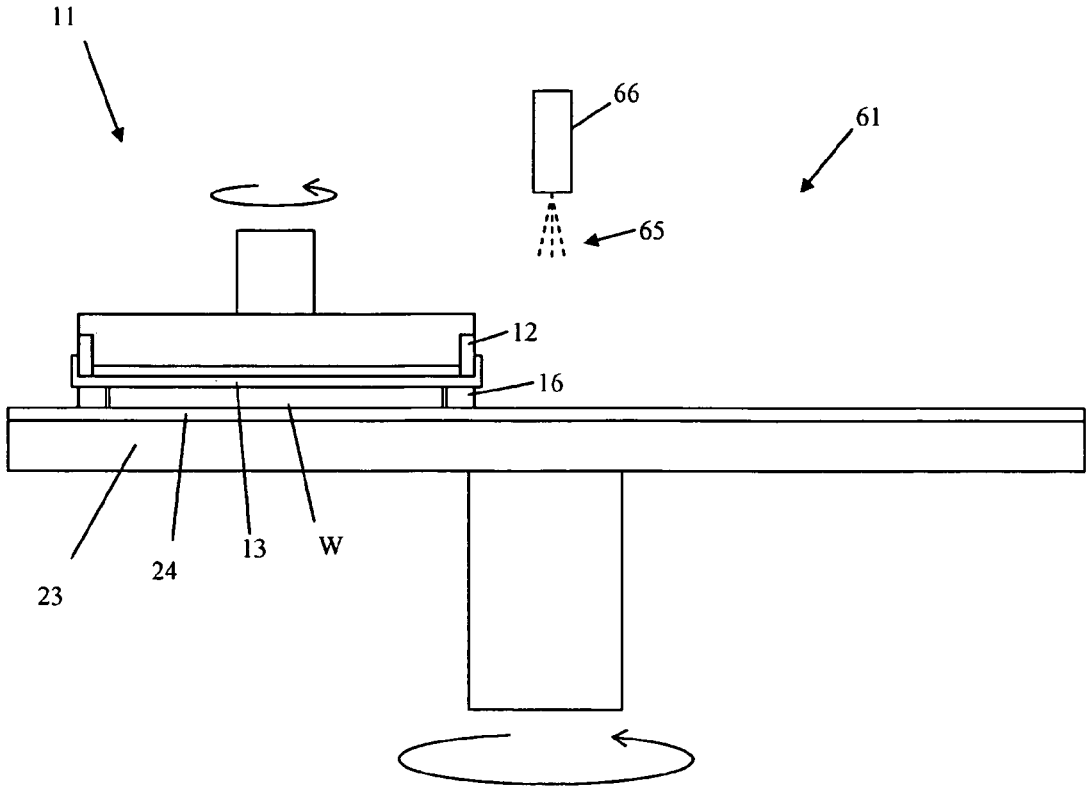
[Fig. 3]
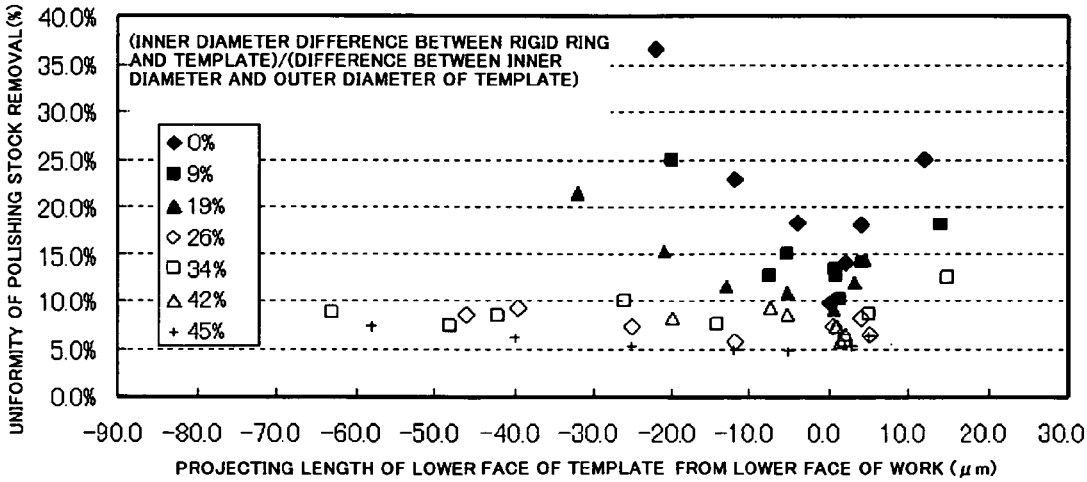

Figs. 4
(a)
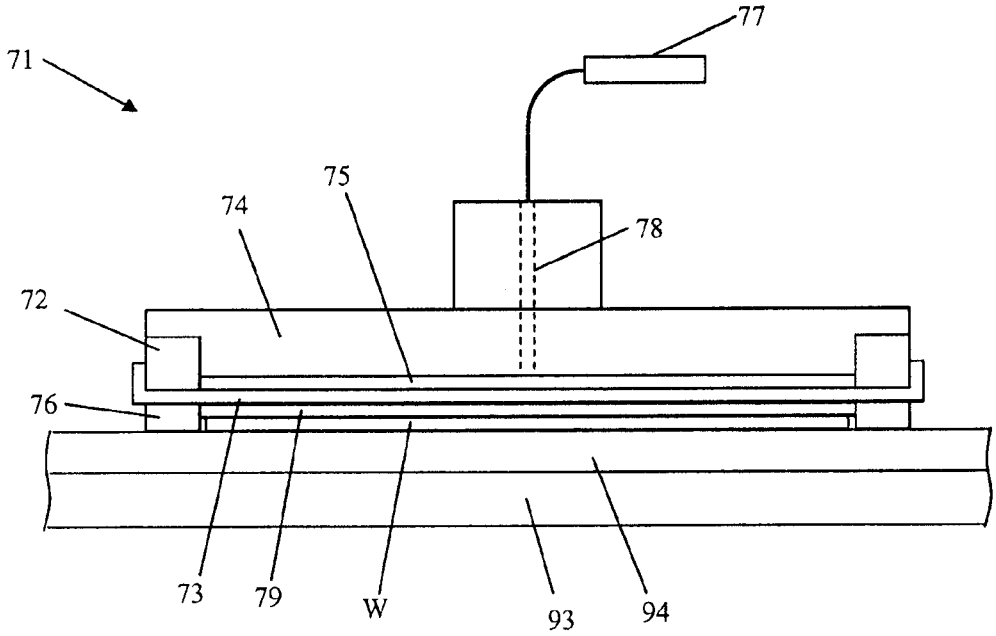
PRIOR ART
(b)
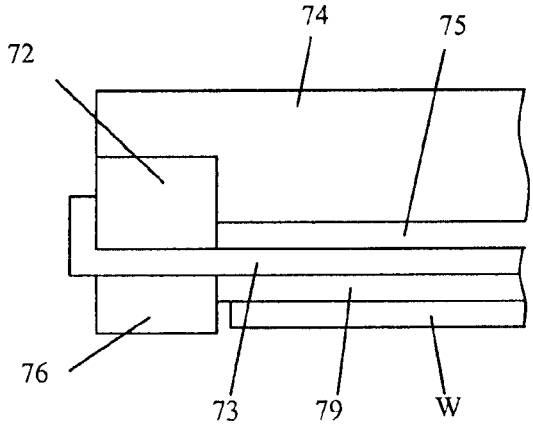
PRIOR ART

PRIOR ART

POLISHING HEAD AND POLISHING APPARATUS

TECHNICAL FIELD

The present invention relates to a polishing head for holding a work when a surface of the work is polished and a polishing apparatus provided with it, and particularly to a polishing head for holding a work on a rubber film and a polishing apparatus provided with it.

BACKGROUND ART

As a apparatus for polishing a surface of a work such as a silicon wafer, a single-side polishing apparatus in which the work is polished by each face and a double-side polishing apparatus in which the both faces are polished at the same time.

A general single-side polishing apparatus comprises, as shown in FIG. 5, for example, a turn table 93 onto which a polishing pad 94 is attached, a polishing agent supply mechanism 96, a polishing head 92 and the like. In such a polishing apparatus 91, polishing is performed by holding a work W by the polishing head 92, supplying the polishing agent 95 onto the polishing pad 94 from the polishing agent supply mechanism 96, and rotating the turn table 93 and the polishing head 92, respectively, so as to bring the surface of the work W into sliding contact with the polishing pad 94.

As a method of holding the work on the polishing head, there is a method of attaching the work onto a flat disk-shaped plate through an adhesive such as a wax and the like. Other than that, particularly as a holding method of suppressing rise or sag of the work on its outer circumference portion and of improving flatness of the entire work, there is a so-called rubber-chuck method in which a work holding portion is made of a rubber film, a pressurized fluid such as air is poured into a back face of the rubber film, and the rubber film is inflated by a uniform pressure so as to press the work onto the polishing pad (See Japanese Unexamined Patent Publication (Kokai) No. H5-69310, for example).

An example of configuration of the prior-art rubber chuck polishing head is schematically shown in FIG. 4(*a*) and an enlarged diagram of a peripheral portion of the polishing head is shown in FIG. 4(*b*). An essential part of a polishing head 71 is a rigid ring 72 made of an annular SUS (stainless steel) and the like, a rubber film 73 bonded to the rigid ring 72, and a mid plate 74 joined to the rigid ring 72. A sealed space 75 is defined by the rigid ring 72, the rubber film 73, and the mid plate 74. Also, an annular template 76 is provided concentrically with the rigid ring 72 in the peripheral portion on a lower face part of the rubber film 73. Also, a through hole 78 for pressure adjustment communicating with a pressure adjustment mechanism 77 is provided at the center of the mid plate 74 so that a pressure of the space 75 is adjusted by supplying pressurized fluid by the pressure adjustment mechanism 77 and the like. Also, pressing means, not shown, for pressing the mid plate 74 in the direction of the polishing pad 94 is provided.

Using the polishing head configured as above, the work W is held on the lower face part of the rubber film 73 through a backing pad 79, an edge portion of the work W is held by the template 76, and the work W is brought into sliding contact with the polishing pad 94 attached onto an upper face of the turn table 93 by pressing the mid plate 74 for performing polishing.

By holding the work by the rubber film and polishing the work using the polishing head provided with the template as above, flatness (and polishing stock removal uniformity) of the entire work W is improved in some cases, but the flatness is still not favorable in other cases, and there is a problem that constant flatness can not be obtained stably.

DISCLOSURE OF INVENTION

Then, the present invention was made in view of the above problem and has an object to provide a polishing head that can stably obtain constant flatness.

The present invention was made in order to solve the above problem and provides a polishing head provided at least with an annular rigid ring, a rubber film bonded to the rigid ring with a uniform tension, a mid plate joined to the rigid ring and forming a space together with the rubber film and the rigid ring, and an annular template provided concentrically with the rigid ring in a peripheral portion on a lower face part of the rubber film and having an outer diameter larger than an inner diameter of the rigid ring, in which a pressure of the space can be changed by a pressure adjustment mechanism, a back face of a work is held on the lower face part of the rubber film, and a surface of the work is brought into sliding contact with the polishing pad attached onto a turn table for performing polishing, wherein an inner diameter of the template is smaller than an inner diameter of the rigid ring, and a ratio between an inner diameter difference between the rigid ring and the template and a difference between the inner diameter and an outer diameter of the template is 26% or more and 45% or less.

In the polishing head configured as above, if it is a polishing head in which the inner diameter of the template is smaller than the inner diameter of the rigid ring, and the ratio between an inner diameter difference between the rigid ring and the template and the difference between the inner diameter and the outer diameter of the template is 26% or more and 45% or less, an inner circumference portion of the template can be freely deformed, and holding of the work by the rubber film and polishing thereof can be carried out by a more uniform pressing force over the entire face of the work. As a result, even if a positional relation between the lower face of the work and the lower face of the template slightly varies, the polishing stock removal uniformity can be kept favorably.

In this case, the inner diameter of the template is larger than the outer diameter of the work by 0.5 mm or more and 2.0 mm or less, and the outer diameter of the template is preferably larger than the outer diameter of the work by 10% or more and 20% or less.

If the inner diameter of the template is larger than the outer diameter of the work by 0.5 mm or more and 2.0 mm or less, and the outer diameter of the template is larger than the outer diameter of the work by 10% or more and 20% or less, the work can be assuredly held without breakage and elimination of the template during the work polishing can be prevented. Also, a work polishing speed can be favorably controlled.

Also, the work to be polished may be a silicon single crystal wafer with a diameter of 300 mm or more.

Even if the work to be polished is a silicon single crystal wafer with a large diameter of 300 mm or more as above, with the polishing head according to the present invention, the work can be held by the rubber film and polished on the entire surface of the work with more uniform pressing force. As a result, even if the positional relation between the lower face of the work and the lower face of the template slightly varies, the polishing stock removal uniformity can be kept favorably.

Also, when the work is held by the polishing head, the thickness of the template is preferably set so that the position of the lower face of the work is lower than the position of 60

μm above the lower face of the template and higher than the position of 5 μm below the lower face of the template.

If the thickness of the template is set so that the position of the lower face of the work is lower than the position of 60 μm above the lower face of the template and higher than the position of 5 μm below the lower face of the template when the work is held by the polishing head as above, polishing can be performed more assuredly while polishing stock removal uniformity is kept high.

Moreover, in the present invention, a polishing apparatus used when a surface of a work is polished and provided at least with a polishing pad attached onto a turn table, a polishing agent supply mechanism for supplying a polishing agent onto the polishing pad, and the polishing head according to the present invention as a polishing head for holding the work is provided.

As mentioned above, if the work is polished using the polishing apparatus provided with the polishing head according to the present invention, the holding of the work by the rubber film and polishing thereof can be carried out with a more uniform pressing force over the entire face of the work. As a result, even if the positional relation between the lower face of the work and the lower face of the template slightly varies, the polishing stock removal uniformity can be kept favorably.

Since an inner circumference portion of the template can be freely deformed by polishing the work using the polishing head according to the present invention, the holding of the work by the rubber film and polishing thereof can be carried out with a more uniform pressing force over the entire face of the work. As a result, even if the positional relation between the lower face of the work and the lower face of the template slightly varies, the polishing stock removal uniformity can be kept favorably. That is, even if the thickness of the work or the thickness of the template slightly varies, polishing can be carried out while the polishing stock removal uniformity is kept favorably.

BRIEF DESCRIPTION OF DRAWINGS

FIG. 1 are schematic sectional views illustrating a polishing head according to the present invention, in which FIG. 1(*a*) is a schematic sectional view illustrating the entire polishing head and FIG. 1(*b*) is an enlarged view illustrating its peripheral portion;

FIG. 2 is a schematic configuration diagram illustrating an example of a polishing apparatus provided with the polishing head according to the present invention;

FIG. 3 is a graph illustrating a relation between a projecting length of a work lower face from a template lower face and polishing stock removal uniformity;

FIG. 4 are schematic sectional views illustrating a prior art polishing head, in which FIG. 4(*a*) is a schematic sectional view illustrating the entire polishing head and FIG. 4(*b*) is an enlarged view illustrating its peripheral portion.

BEST MODE(S) FOR CARRYING OUT THE INVENTION

Figure 5:
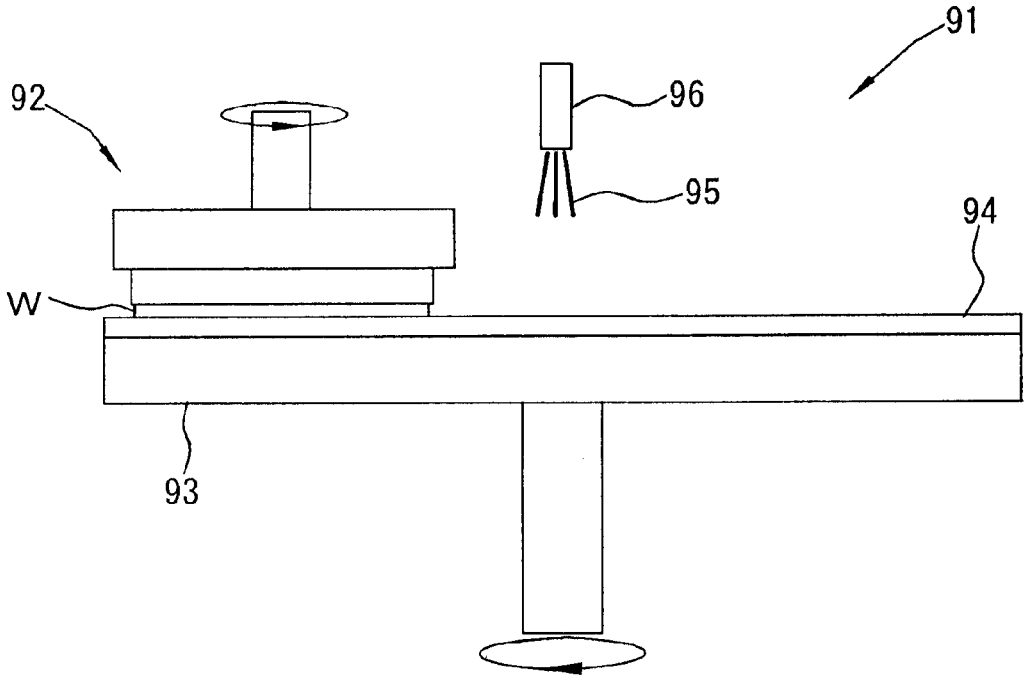
FIG. 5 is a schematic configuration diagram illustrating an example of a single-side polishing apparatus.

The present invention will be described below in more detail.

As mentioned above, even if the work is held by the rubber film and the work is polished using the polishing head provided with the template, favorable flatness can not be obtained in some cases, and there is the problem that constant flatness can not be obtained stably.

Then, the inventors have keenly conducted experiments and examination on the cause of the problem.

As a result, the inventors have found out the following. That is, if a lower face of the work to be polished and a lower face of the template holding the work at an edge portion has a predetermined positional relation, it is known that favorable polishing stock removal uniformity is obtained. And when such a positional relation is not established, rise or sag of an outer circumferential shape of the work occurs, and the polishing stock removal uniformity is deteriorated. Specifically, if the lower face of the work excessively projects with respect to the lower face of the template, an outer circumferential sag occurs, while if the lower face of the work excessively retreats with respect from the lower face of the template, it becomes a shape raised on the outer circumference.

That is, it was found out that if the positional relation between the lower face of the work and the lower face of the template is adjusted, for example, by adjusting the thickness of the template, the polishing stock removal uniformity can be made favorable. However, with the prior art polishing head, a range of values of a lower-face difference between the work and the template allowed to obtain the favorable polishing stock removal uniformity is only several μm, and also, if the work is a silicon single crystal wafer, the work thickness usually has variation of approximately ±10 μm or more, for example, and since the template thickness also has variation, it was found out that precise adjustment within several μm or the like is difficult.

Then, as the result of further keen experiments and examination by the inventors, they conceived to have a structure in which the template is extended inward from a rigid ring (also referred to as "overhang") so that the inner circumference portion of the template can be freely deformed and even if the positional relation between the work lower face and the template lower face somewhat varies, an influence on a polished shape can be reduced and they optimized conditions and completed the present invention.

The polishing head and the polishing apparatus according to the present invention will be specifically described below referring to the attached drawings, but the present invention is not limited to that. FIG. 1 show an example of the polishing head according to the present invention. FIG. 1(*a*) is a schematic sectional view showing the entire polishing head, and FIG. 1(*b*) is an enlarged view showing its peripheral portion. This polishing head 11 is provided with an annular rigid ring 12 made of a rigid material such as SUS (stainless steel) and the like, a rubber film (elastic film) 13 bonded to the rigid ring 12 with a uniform tension and having a flat lower face, and a mid plate 14 joined to the rigid ring 12 with a bolt and the like. The rigid ring 12, the rubber film 13, and the mid plate 14 define a sealed space 15. Also, on the lower face portion of the rubber film 13, the work W is held. The thickness of the rubber film 13 is not particularly limited and an arbitrary and convenient thickness may be chosen, but it may be approximately 1 mm thick, for example. Also, a material, a shape and the like of the mid plate are not particularly limited but it may be arbitrary as long as the space 15 can be formed.

Also, in the peripheral portion on the lower face part of the rubber film 13, an annular template 16 is provided concentrically with the rigid ring 12. The template 16 is used for holding an edge portion of the work W and is bonded so as to project downward along the outer circumference portion of the lower face part of the rubber film 13. At this time, an inner diameter of the template 16 is preferably larger than an outer diameter of the work W by 0.5 mm or more and 2.0 mm or less. That is because if the inner diameter of the template 16 is larger than the outer diameter of the work W by less than 0.5 mm, the work W can not be held well in view of a positioning accuracy of the work W. On the other hand, if the inner diameter of the template 16 is larger than the outer diameter of the work W by more than 2.0 mm, an impact during polishing is large between the template 16 and the edge portion of the work W, and there is a high possibility that the work W might be broken. Also, the outer diameter of the template 16 is larger than the outer diameter of the work W in a range of 10% or more and 20% or less. That is because if the outer diameter of the template 16 is larger than the outer diameter of the work W in a range less than 10%, an adhesion area of the template 16 can not be secured sufficiently, and there is a problem that the template 16 is separated during the polishing of the work W or due to a small width of the template 16 (template width) and an insufficient holding of the work W, the work W is eliminated from the template 16 during the polishing and jumps out and the like. On the other hand, if the outer diameter of the template 16 is larger than the outer diameter of the work W by more than 20%, the polishing agent is hard to enter inside the template 16 and there is a problem that a polishing speed is extremely lowered.

Also, the template 16 is set to have the outer diameter at least larger than the inner diameter of the rigid ring 12, and its inner diameter is set smaller than the inner diameter of the rigid ring 12. In this case, since the rigid ring 12 and the template 16 are concentric, the template 16 extends inward from the rigid ring 12. The extending length of the template 16 from the rigid ring 12 is called an overhang length. And for the reason which will be described later, a ratio between an inner diameter difference between the rigid ring 12 and the template 16 and a difference between the inner diameter and the outer diameter of the template 16 is set at 26% or more and 45% or less (that is, a ratio between the overhang length and the width of the template 16 is set at 26% or more and 45% or less).

Also, the material of the template 16 is preferably a material which is softer than the work so as not to contaminate the work W and give a scratch or impression, and is highly abrasion resistant material so as to be hard to be worn even if being brought into sliding contact with the polishing pad 24 during the polishing.

Also, a through hole 18 for pressure adjustment communicating with a pressure adjustment mechanism 17 is provided at the center of the mid plate 14, for adjusting the pressure in the space 15 by supplying a pressurized fluid from the pressure adjustment mechanism 17 and the like. Also, pressing means, not shown, for pressing the mid plate 14 in the direction of the polishing pad 24 is provided.

Other than the above, a backing pad 19 may be attached to be installed on a lower face of the rubber film 13. The backing pad 19 is made to contain water so as to attach the work W and to hold the work W on a work holding face of the rubber film 13. The backing pad 19 may be made of foamed polyurethane, for example. By providing such backing pad 19 and having it contain water, the work W can be surely held by a surface tension of the water contained in the backing pad 19. FIG. 1 show a mode in which the template 16 is directly bonded to the rubber film 13, but the present invention does not exclude a case in which the template 16 is bonded to the rubber film 13 through the backing pad 19 and the like.

Using the polishing head 11 configured as above, the mid plate 14 is pressed in the direction of the polishing pad 24 attached onto the turn table 23 by mid-plate pressing means, not shown, and the work W is brought into sliding contact with the polishing pad 24 for polishing the work surface. The mid-plate pressing means is preferably able to press the mid plate 14 over the entire face with a uniform pressure.

By making the inner diameter of the template 16 smaller than the inner diameter of the rigid ring 12 in configuring the polishing head 11 as above, the inner circumference portion of the template 16 can be freely deformed, by adjusting the pressure in the space 15 appropriately, automatic relaxation is made so that the positional relation between the lower face (polished surface) of the work W during the polishing and the lower face of the template 16 gets close to appropriate positions, and even if the thickness of the work W or the thickness of the template 16 slightly varies, the polishing can be carried out while a pressing force applied on the work W is kept uniform over the entire face, and as a result, the polishing can be carried out while the polishing stock removal uniformity of the work W is kept favorable.

The inventors have conducted the following experiments in order to obtain a specific range of the inner diameter difference between the rigid ring 12 and the template 16.

(Experiment)

The polishing head 11 configured as shown in FIG. 1 was manufactured as follows by changing the overhang length of the template 16 from the rigid ring 12. First, on an outer circumference of the rigid ring 12 (outer diameter: 360 mm) made of SUS and having its upper part blocked by the mid plate 14, the rubber film 13 was attached with a uniform tensile force. On the work holding face of the rubber film 13, the backing pad 19 was attached with a double-side tape, and the annular template 16 with the outer diameter of 355 mm and the inner diameter of 302 mm (that is, the difference between the outer diameter and the inner diameter was 53 mm, and the template width was 26.5 mm) was bonded with the double-side tape so that the template was adjacent to the periphery of the backing pad 19. However, the rigid rings having such an inner diameter that the inner diameter difference between the rigid ring 12 and the template 16 is 0, 5, 10, 14, 18, 22, 24, 26 mm (0, 2.5, 5, 7, 9, 11, 12, 13 mm as the overhang length of the template 16 from the rigid ring 12, respectively) were prepared, respectively, and replaced for use.

A relation between the inner diameter difference between the rigid ring 12 and the template 16 and a ratio between the inner diameter difference between the rigid ring 12 and the template 16 and the difference between the inner diameter and the outer diameter of the template 16 are shown in TABLE 1.

TABLE 1

| Inner diameter difference between rigid ring and template (mm) | (Inner diameter difference between rigid ring and template)/ (difference between inner diameter and outer diameter of template) (%) |
|---|---|
| 0 | 0 |
| 5 | 9 |
| 10 | 19 |
| 14 | 26 |
| 18 | 34 |
| 22 | 42 |
| 24 | 45 |
| 26 | 49 |

By using the polishing apparatus provided with the polishing head 11 as mentioned above, a silicon single crystal wafer with the diameter of 300 mm and the thickness of 775 μm as the work W was polished as follows. The used silicon single crystal wafer is given primary polishing on its both faces in advance and its edge portion is also polished. Also, the turn table 23 with the diameter of 800 mm was used, and a usual one was used as the polishing pad 24.

At the polishing, an alkali solution containing coroidal silica was used as the polishing agent, and the polishing head 11 and the turn table 23 were rotated at 31 rpm and 29 rpm, respectively. A polishing load (pressing force) of the work W was set at 15 kPa. The polishing time was 10 minutes.

The polishing stock removal uniformity of the work W polished as above was evaluated. The polishing stock removal uniformity is obtained by measuring the thickness of the work before and after the polishing in a region excluding an outermost circumference portion 2-mm width as a flatness guarantee area in a plane by a flatness measurement instrument and by taking a difference in the polishing stock removal and represented by a formula of polishing stock removal uniformity (%)=(maximum polishing stock removal in the plane−minimum polishing stock removal in the plane)/average polishing stock removal in the plane.

The result is shown in FIG. 3 in a graph of a relation between a projecting length of the work W lower face from the template 16 lower face when the work W is held by the polishing head 11 (if the sign is positive, it means that the lower face of the work W is lower than the lower face of the template 16, while if the sign is negative, it means that the lower face of the work W is higher than the lower face of the template 16) and the polishing stock removal uniformity.

From FIG. 3, if the ratio between the inner diameter difference between the rigid ring 12 and the template 16 and the difference between the inner diameter and the outer diameter of the template 16 was 26 to 45%, when the projecting length of the work W lower face from the template 16 lower face is within a range of approximately 5 μm to −60 μm, the polishing stock removal uniformity was favorable at 10% or less. On the other hand, if the ratio of the inner diameter difference between the rigid ring 12 and the template 16 was smaller than that, the polishing stock removal uniformity was sensitively influenced by the projecting length of the work W lower face from the template 16 lower face and largely varied. Also, if the ratio of the inner diameter difference between the rigid ring 12 and the template 16 was 49%, a twist occurs in the rubber film 13, the backing pad 19 and the work W were removed, and the polishing could not be performed in some cases.

From the results of the above experiments, it was known that if the ratio between the inner diameter difference between the rigid ring 12 and the template 16 and the difference between the inner diameter and the outer diameter of the template 16 was 26% or more and 45% or less, even if the projecting length of the work W lower face from the template 16 lower face relatively varied in a range of approximately 5 μm to −60 μm, the work could be polished while favorable polishing stock removal uniformity was kept.

In order to keep the inner diameter difference between the rigid ring 12 and the template 16 within this range, if the diameter of the work W to be polished is determined by specification, the inner diameter difference between the rigid ring 12 and the template 16 is adjusted by changing the inner diameter of the rigid ring 12 without changing the inner diameter of the template 16. However, the present invention is not limited to that, but the inner diameter of the template 16 may be changed depending on the diameter of the work W.

By polishing the work W using the polishing head 11 having the inner diameter difference between the rigid ring 12 and the template 16 within this range, since the inner circumference portion of the template 16 is freely deformed during the polishing and the positional relation between the work lower face (polished surface) and the lower face of the template 16 is automatically relaxed, even if the thickness of the work W or the thickness of the template 16 slightly varies, the polishing can be performed while keeping the polishing stock removal uniformity of the work favorably. Specifically, when the work is held by the polishing head, by setting the thickness of the template so that the position of the lower face of the work is lower than the position 60 μm above the lower face of the template and higher than the position 5 μm below the lower face of the template, the polishing can be performed more surely while keeping the polishing stock removal uniformity of the work favorably.

FIG. 2 shows an outline of a polishing apparatus 61 provided with the above polishing head 11. The polishing apparatus 61 is provided with the polishing pad 24 attached onto the turn table 23 and a polishing agent supply mechanism 66 for supplying a polishing agent 65 onto the polishing pad 24 in addition to the polishing head 11.

In order to polish the work W using the polishing apparatus 61, the work W is attached onto the backing pad 19 containing water and the back face of the work W is held by the rubber film 13, while the edge portion of the work W is held by the template 16.

And a polishing agent 65 is supplied onto the polishing pad 24 from the polishing agent supply mechanism 66, and while the polishing head 11 and the turn table 23 are rotated in predetermined directions, respectively, the work W is brought into sliding contact with the polishing pad 24. The surface of the work W can be polished by pressing the work W held by the rubber film 13 onto the polishing pad 24 on the turn table 23 with a predetermined pressing force while rotating it.

If the work W is polished using the polishing apparatus 61 provided with the polishing head 11 as above, since it is constructed so that the ratio between the inner diameter difference between the rigid ring 12 and the template 16 and the difference between the inner diameter and the outer diameter of the template 16 is 26% or more and 45% or less, the polishing can be performed with a uniform pressing force over the entire face of the work W, and even if the thickness of the work W slightly varies, the polishing can be performed while the polishing stock removal uniformity of the work is kept favorable.

The present invention is not limited to the above embodiment. The above embodiment is a mere exemplification, and anything having substantially the same configuration as the technical idea described in claims of the present invention and exerting the similar actions and effects is included in the technical scope of the present invention.

For example, the polishing head according to the present invention is not limited to the mode shown in FIG. 1 but the shape and the like of the mid plate can be designed as appropriately, for example.

Also, the configuration of the polishing apparatus is not limited to that shown in FIG. 2, but it may be a polishing apparatus provided with a plurality of the polishing heads according to the present invention, for example.

The invention claimed is:

1. A polishing head provided at least with an annular rigid ring, a rubber film bonded to the rigid ring with a uniform tension, a mid plate joined to the rigid ring and forming a space together with the rubber film and the rigid ring, and an annular template provided concentrically with the rigid ring in a peripheral portion on a lower face part of the rubber film and having an outer diameter larger than an inner diameter of the rigid ring, in which a pressure of the space can be changed by a pressure adjustment mechanism, a back face of a work is held on the lower face part of the rubber film, and a surface of the work is brought into sliding contact with the polishing pad attached onto a turn table for performing polishing, wherein an inner diameter of the template is smaller than an inner diameter of the rigid ring, and a ratio between an inner diameter difference between the rigid ring and the template and a difference between the inner diameter and an outer diameter of the template is 26% or more and 45% or less.

2. The polishing head according to claim 1, wherein the inner diameter of the template is larger than the outer diameter of the work by 0.5 mm or more and 2.0 mm or less, and the outer diameter of the template is larger than the outer diameter of the work by 10% or more and 20% or less.

3. The polishing head according to claim 1, wherein the work to be polished is a silicon single crystal wafer with a diameter of 300 mm or more.

4. The polishing head according to claim 2, wherein the work to be polished is a silicon single crystal wafer with a diameter of 300 mm or more.

5. The polishing head according to claim 1, wherein, when the work is held by the polishing head, a thickness of the template is set so that a position of a lower face of the work is lower than a position of 60 μm above the lower face of the template and higher than a position of 5 μm below the lower face of the template.

6. The polishing head according to claim 2, wherein, when the work is held by the polishing head, a thickness of the template is set so that a position of a lower face of the work is lower than a position of 60 μm above the lower face of the template and higher than a position of 5 μm below the lower face of the template.

7. The polishing head according to claim 3, wherein, when the work is held by the polishing head, a thickness of the template is set so that a position of a lower face of the work is lower than a position of 60 μm above the lower face of the template and higher than a position of 5 μm below the lower face of the template.

8. The polishing head according to claim 4, wherein, when the work is held by the polishing head, a thickness of the template is set so that a position of a lower face of the work is lower than a position of 60 μm above the lower face of the template and higher than a position of 5 μm below the lower face of the template.

9. A polishing apparatus used when a surface of a work is polished and provided at least with a polishing pad attached onto a turn table, a polishing agent supply mechanism for supplying a polishing agent onto the polishing pad, and the polishing head according to claim 1 as a polishing head for holding the work.

10. A polishing apparatus used when a surface of a work is polished and provided at least with a polishing pad attached onto a turn table, a polishing agent supply mechanism for supplying a polishing agent onto the polishing pad, and the polishing head according to claim 2 as a polishing head for holding the work.

11. A polishing apparatus used when a surface of a work is polished and provided at least with a polishing pad attached onto a turn table, a polishing agent supply mechanism for supplying a polishing agent onto the polishing pad, and the polishing head according to claim 3 as a polishing head for holding the work.

12. A polishing apparatus used when a surface of a work is polished and provided at least with a polishing pad attached onto a turn table, a polishing agent supply mechanism for supplying a polishing agent onto the polishing pad, and the polishing head according to claim 4 as a polishing head for holding the work.

13. A polishing apparatus used when a surface of a work is polished and provided at least with a polishing pad attached onto a turn table, a polishing agent supply mechanism for supplying a polishing agent onto the polishing pad, and the polishing head according to claim 5 as a polishing head for holding the work.

14. A polishing apparatus used when a surface of a work is polished and provided at least with a polishing pad attached onto a turn table, a polishing agent supply mechanism for supplying a polishing agent onto the polishing pad, and the polishing head according to claim 6 as a polishing head for holding the work.

15. A polishing apparatus used when a surface of a work is polished and provided at least with a polishing pad attached onto a turn table, a polishing agent supply mechanism for supplying a polishing agent onto the polishing pad, and the polishing head according to claim 7 as a polishing head for holding the work.

16. A polishing apparatus used when a surface of a work is polished and provided at least with a polishing pad attached onto a turn table, a polishing agent supply mechanism for supplying a polishing agent onto the polishing pad, and the polishing head according to claim 8 as a polishing head for holding the work.

* * * * *